US007337591B2

(12) United States Patent
Molina

(10) Patent No.: US 7,337,591 B2
(45) Date of Patent: Mar. 4, 2008

(54) BUILDING CONSTRUCTION SYSTEM

(75) Inventor: Enrique Molina, Guatemala (GT)

(73) Assignee: Inteplast Group, Ltd., Lolita, TX (US)

( * ) Notice: Subject to any disclaimer, the term of this patent is extended or adjusted under 35 U.S.C. 154(b) by 1099 days.

(21) Appl. No.: 09/995,486

(22) Filed: Nov. 28, 2001

(65) Prior Publication Data

US 2003/0097812 A1 May 29, 2003

(51) Int. Cl.
*E04C 2/34* (2006.01)
*E04B 2/28* (2006.01)

(52) U.S. Cl. ..... 53/426; 52/425; 52/427; 52/428; 52/444; 52/740.7; 52/745.12; 52/745.13; 52/745.1; 52/745.05; 52/762.1

(58) Field of Classification Search ..... 249/40, 249/96, 97; 264/35; 52/740.7, 741.13, 742.12, 52/742.13, 742.14, 712–714, 741.1, 425–428, 52/444, 454, 251, 259, 745.15
See application file for complete search history.

(56) References Cited

U.S. PATENT DOCUMENTS

| | | | | |
|---|---|---|---|---|
| 963,431 | A | | 7/1910 | Gates et al. |
| 1,141,057 | A | | 5/1915 | Heltzer |
| 1,389,803 | A | | 9/1921 | Wolfe |
| 1,453,557 | A | | 5/1923 | Wagner |
| 1,692,166 | A | | 11/1928 | Gates |
| 1,692,167 | A | | 11/1928 | Gates |
| 1,755,960 | A | | 4/1930 | Kohler |
| 1,875,136 | A | | 8/1932 | Podd |
| 2,413,415 | A | | 12/1946 | Olson |
| 2,504,043 | A | | 4/1950 | Parker |
| 2,516,318 | A | | 7/1950 | Hawes |
| 2,653,469 | A | * | 9/1953 | Callan ..... 52/274 |
| 2,815,656 | A | | 12/1957 | Klein et al. |
| 3,089,217 | A | | 5/1963 | Filippi |
| 3,238,684 | A | | 3/1966 | Wood |
| 3,455,074 | A | | 7/1969 | Rice |
| 3,481,575 | A | | 12/1969 | Arrighini |
| 3,525,293 | A | | 8/1970 | Leylen et al. |
| 3,706,168 | A | | 12/1972 | Pilish |
| 3,714,304 | A | * | 1/1973 | Carner et al. ..... 264/572 |
| 3,728,836 | A | | 4/1973 | Gates |

(Continued)

*Primary Examiner*—Jeanette Chapman
(74) *Attorney, Agent, or Firm*—Neil F. Markva

(57) ABSTRACT

A structural forming assembly comprises wall molding panels for forming laterally spaced, opposed molding surfaces that define a wall mold cavity for forming a wall structure. The wall panels are vertically disposed and laterally spaced to provide the molding surfaces along opposed sides of the wall mold cavity. Reinforcement rod suspending grid elements attached to the opposed wall forming panels are for freely positioning and retaining horizontally and freely disposed reinforcement rods at a preselected horizontal location spaced inwardly from each opposed molding surface within the mold cavity, and at spaced preselected vertical locations between the molding surfaces. The rod suspending elements are effective to retain reinforcement rods in place at the preselected horizontal and vertical locations while the hardenable material is being poured into an upwardly directed top mold opening and allowed to harden within the wall mold cavity. The invention includes a fixed construction that comprises a monolithic building structure including a floor slab having a top surface, and an upper building portion having a ceiling slab and a wall structure, which extends along the floor top surface in a room layout of a building in accord with a preselected floor plan.

14 Claims, 6 Drawing Sheets

U.S. PATENT DOCUMENTS 3,734,451 A 5/1973 Tierney
3,961,002 A 6/1976 Brown
4,145,861 A 3/1979 Yarnick
4,209,985 A * 7/1980 Master ..... 60/337
4,234,156 A * 11/1980 Wepf ..... 249/40
4,272,050 A 6/1981 del Valle
4,290,985 A * 9/1981 Barale ..... 264/31
4,320,606 A * 3/1982 GangaRao ..... 52/125.5
4,426,061 A 1/1984 Taggart
4,494,353 A * 1/1985 Lewis ..... 52/745.19
4,501,098 A 2/1985 Gregory
4,516,372 A * 5/1985 Grutsch ..... 52/309.12
4,624,089 A * 11/1986 Dunker ..... 52/410
4,655,014 A * 4/1987 Krecke ..... 52/105
4,768,324 A * 9/1988 Hibbard ..... 52/742.14
4,864,792 A 9/1989 Andre et al.
4,972,646 A 11/1990 Miller et al.
5,163,263 A * 11/1992 DeSchutter et al. ..... 52/742.14
5,218,809 A 6/1993 Baumann
5,246,640 A * 9/1993 Bryant ..... 264/35
5,376,315 A * 12/1994 Fricke ..... 264/31
5,431,368 A * 7/1995 Wilde ..... 249/213
5,535,565 A 7/1996 Majnaric et al.
5,547,163 A 8/1996 Lack
5,570,552 A 11/1996 Nehring
5,732,753 A * 3/1998 Danzi et al. ..... 141/340
5,771,648 A 6/1998 Miller et al.
5,927,043 A * 7/1999 Newkirk ..... 52/742.14
6,070,380 A * 6/2000 Meilleur ..... 52/309.7
6,231,025 B1 * 5/2001 Takemura ..... 249/40
6,739,102 B2 * 5/2004 Roy, Sr. ..... 52/294
6,907,709 B2 * 6/2005 Byrd ..... 52/742.14

* cited by examiner

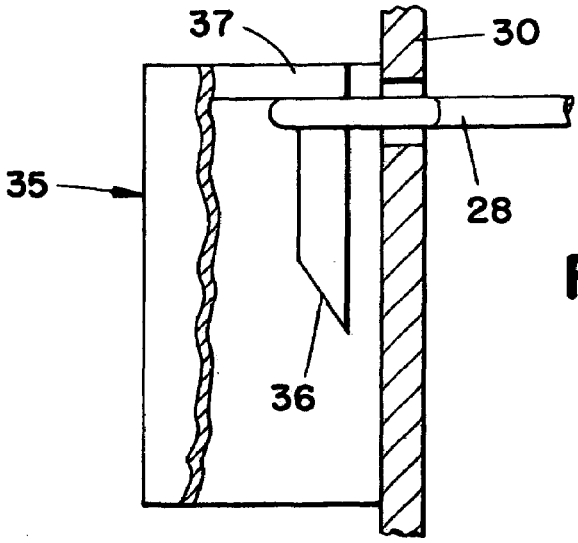
FIG. 6
FIG. 7
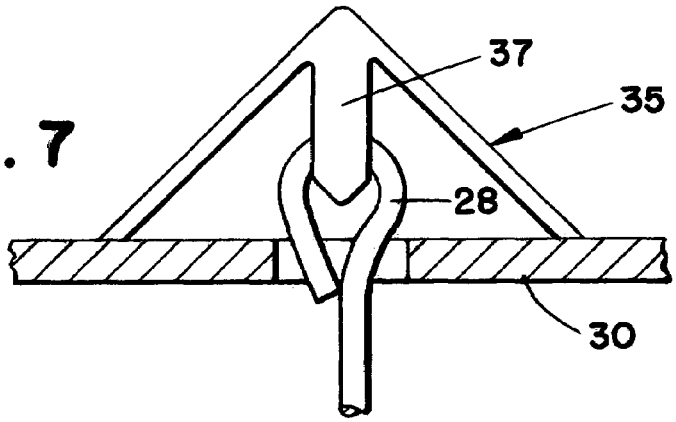
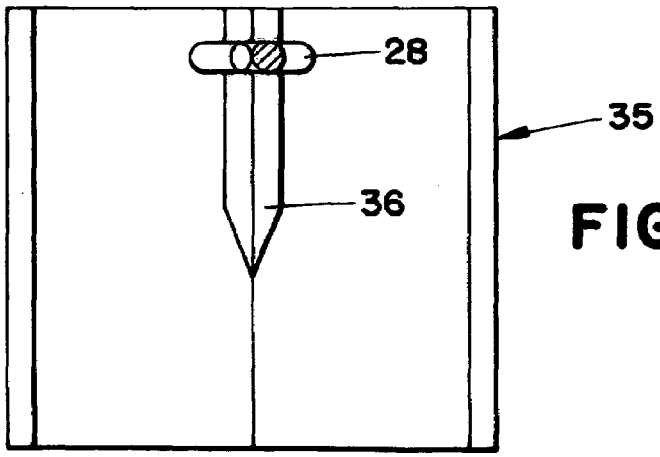
FIG. 8

BUILDING CONSTRUCTION SYSTEM

FIELD OF THE INVENTION

This invention relates to a method and apparatus for forming reinforced poured-in-place buildings for home and office. More particularly, the invention relates to a method and apparatus for producing a monolithic building on site using a unique poured-in-place fabrication technique using hardenable material such as concrete to form the desired novel constructions of the invention.

BACKGROUND OF THE INVENTION

The two major categories of concrete fabrication are poured-in-place concrete and pre-cast concrete. Poured-in-place concrete has the advantage of permitting a great deal of flexibility as to the form or shape of the structure being made. Until the current invention such poured-in-place concrete methods have been limited to methods that are quite costly of time, labor, and materials.

U.S. Pat. No. 3,089,217 discloses the common poured-in-place practice of erecting a form system having parallel spaced panels interconnected by a tie system which traverses the space between the panels to form concrete walls wherein the central members of the tie system remain embedded in the concrete. The primary advantage of such an arrangement is that the forces resulting from the deposition of the initially plastic concrete are balanced out between the opposite form panels, and thus require a minimum of bracing from the outside. Such bracing is limited to maintaining the vertical orientation of the assembled form system. A core box and special ceiling forms are required to complete the disclosed construction procedure.

U.S. Pat. No. 2,516,318 is directed to a removable wall panel support structure for forming a wall in successive courses.

U.S. Pat. No. 5,218,809 discloses an earthquake resistant poured-in-place concrete structure having horizontal and vertical reinforcing bars. The '809 reinforcement assembly requires the welding of horizontal hanger cross members from which a pair of welded reinforcement grids are freely placed. The horizontal and vertical reinforcing bars are not free of each other and a stress point exists in each of the welded joint sites. There is no disclosure of a reinforcement rod suspending device that is attached to one mold cavity panel and in which reinforcing rods may be freely positioned at preselected horizontal and vertical locations within the mold cavity before the second opposing mold cavity panel is vertically disposed to provide the desired mold cavity.

U.S. Pat. No. 4,864,792 relates to prefabricated modules used in the building industry that comprise an array of flat elements made from light material, and a plurality of nettings made from welded steel wires, which extend along a lengthwise direction of the module and which are welded to a series of cross-wise wires. The nettings comprise lengthwise wires and spacing or brace wires that define sections in which the flat elements are arranged and form two panels used as lost shuttering for casting reinforced concrete. The resistance of the concrete to tensile and shear stresses is insured by a reinforcement from steel wire embedded in the cast concrete.

U.S. Pat. Nos. 1,389,803 and 4,426,061 disclose a poured-in-place concrete construction system having a reinforcement mesh disposed between opposed wall panels that are juxtaposed opposing lateral sides of a poured foundation and tied to be vertically disposed in placed.

U.S. Pat. Nos. 3,238,684 and 3,524,293 show poured-in-place wall forming systems having horizontal and vertical reinforcing rods disposed within a mold cavity formed with permanent wall panels. The '684 rods are held in place using a plurality of ties that have to be individually manipulated for the horizontal and vertical placement of the various rods used in the system. The '293 patent shows the horizontal and vertical reinforcing rods welded together unlike the freely positioned horizontally disposed reinforcement rods of the present invention.

U.S. Pat. No. 2,504,043 discloses a building form used to construct walls in courses so that reinforcing rods are laid parallel to each other in each successive coarse. The '043 process is thus extremely slow in producing a building wall.

U.S. Pat. No. 5,570,552 is directed to a modular wall forming system having a box-like block form of expanded foam plastic material with opposite, parallel, spaced apart sidewalls and end walls extending between upper and lower surfaces and defining an internal cavity for receiving concrete slurry. A plurality of transverse bridge members maintain spacing between the sidewalls at spaced locations along the length thereof. Each bridge member includes a central web extending between opposed tongues which are slidably received in T-grooves formed in the sidewalls, and has a structural configuration for slidably receiving a vertical reinforcement bar a plurality of horizontal reinforcement bars. The mold cavity sidewalls slidably receive the bridge members in a first direction while preventing substantial movement therebetween. Each of the sidewall sections and bridge members have to be handled and individually placed to form the building wall mold cavity.

U.S. Pat. Nos. 963,431 and 2,413,415 show the well known use of tie members for holding vertically and horizontally disposed wall panels in opposed facing position to receive concrete in forming a poured-in-place wall construction.

U.S. Pat. No. 3,728,836 shows a concrete form tie and rebar chair for fixing the position of a vertically disposed reinforcing rod at a location laterally spaced inwardly from the interior surfaces of the opposed wall panels. The form tie includes spreaders that fix the distance between the spaced opposed panels.

U.S. Pat. Nos. 1,692,166; 1,692,167; 1,755,960; 1,875,136; 3,481,575; and 5,547,163 each show variations of form ties that address fixing the spaced distance between opposing walls in a poured concrete forming structure.

U.S. Pat. Nos. 1,141,057 and 2,815,656 respectively disclose the formation of an upstanding curb portion on a molded concrete road slab and a foundation having an upstanding wall portion on which a wall of corrugated panels are vertically disposed.

U.S. Pat. No. 3,734,451 discloses a concrete wall form having a plurality of interconnected, unitary metal panels comprised of one or more extruded, channel-shaped intermediate sections and an extruded, channel-shaped end section at either end of the intermediate section.

U.S. Pat. Nos. 1,453,557; 5,535,565; and 6,070,380 each discloses an assembly having a unique system for attaching spaced horizontal and vertical reinforcing bars in a concrete forming structure in which the grid assembly between the interior surfaces of the panels holds opposed wall panels in place when hardenable material is poured in the mold cavity.

U.S. Pat. Nos. 4,972,646 and 5,771,648 each discloses a concrete forming system including a pair of foam panels having laterally aligned holes arranged in a rectangular grid. Cross wires or rods extend through the holes. Longitudinally extending wires or rods are located against the interior surfaces of the walls and are welded to the cross rods. Retaining means on the ends of the cross rods are disposed against the exterior surfaces of the walls to provide a sandwich construction firmly to interconnect the walls and the rods thereby forming a poured-in-place mold cavity.

The prior art makes numerous attempts to facilitate production of pre-cast reinforced concrete structures. Pre-cast concrete fabrication is directed to the formation of modular units such as building panels and room modules that are subsequently moved to the construction site and disposed into a designed structural position. This technique requires heavy lifting and moving equipment that must work on accessible terrain for accomplishing the desired building construction.

U.S. Pat. No. 4,272,050 discloses a method and apparatus for pre-casting box-like reinforced concrete room modules on an assembly line basis. Each completed module is then moved to a remote construction site and juxtaposed other modules to form a completed building. Apparatus includes a pair of movable interior forms for defining the interior surfaces of side walls and ceilings whereby one interior mold at a time can be removed when concrete is in semi-cured condition. The method includes casting a floor slab with short upstanding side wall portions to serve as guides for moving interior forms in place onto floor slab. The method also includes use of integral multiples of four serially arranged casting beds on which various procedures for forming the room modules proceed simultaneously and progressively.

Each of the pre-cast building construction systems of U.S. Pat. Nos. 3,455,074; 3,706,168; 3,961,002; 4,145,861; and 4,501,098 is associated with a particular floor plan. The '074 patent first forms reinforced modules having walls and ceiling, placing them at a building site, and then pouring floor slabs after the wall and ceiling modules are in place. The '168 prefabricated reinforced concrete building is formed of pre-cast separate footings that are spaced in an arrangement defining the floor plan of the building. Pre-cast wall-forming panels, disposed in edge-abutting relation, are supported by the footings. Roof-forming panels overlie the upper edges of the wall-forming panels. The '002 method and apparatus forms an integral building construction unit of synthetic material such as polyurethene foam that is transported to the building site after its construction. The '861 method includes placing pre-cast wall modules in trenches having the general outline of the building floor plan and subsequently pouring the floor slab and interconnecting the roof or ceiling structure. The '098 construction method forms modular structures at a remote location and later places them on a foundation laid out according to a building floor plan.

Each of the foregoing prior art systems are generally time-consuming with respect to preparation of the forming assemblies either at or remote from the building site; expensive moving and transporting equipment is needed to handle the forming equipment and/or completed modular constructions being moved to the building site; and skilled craftsmen are required to use sophisticated molding equipment to prepare for and effect the placement of hardenable material into the particular mold cavity. The advantages associated with the building construction system of the invention, and products produced thereby avoid these expensive and time-consuming prior art techniques.

PURPOSE OF THE INVENTION

The primary purpose of this invention is to provide affordable housing for people in developing countries throughout the world and is directed to a novel building construction system using poured-in-place fabrication techniques that an indigenous labor force of any nation may be employed and trained to operate.

Another purpose is to provide a floor slab and upper building construction system designed to significantly reduce production time, and to provide novel final building structures to withstand damage caused by seismic forces of an earthquake, and by high velocity wind forces of a tornado or hurricane.

An object of the invention is to provide a structural forming assembly for producing a monolithic building structure having a floor, inner and outer walls, and ceiling that is molded from a hardenable material wherein the building walls define a plurality of rooms of the building according to a preselected building floor plan.

Another object of the invention is to produce a novel molded concrete floor slab having upstanding wall portions that have a structural layout according to a preselected building floor plan and that provide an accurate pattern guide for assembling a wall mold cavity into which a hardenable material is poured and allowed to harden to form inner and outer wall segments that define the rooms of a building structure.

A further object of the invention is to provide a reinforcement rod suspending structure that is attached to a first molding surface of a wall mold cavity for freely positioning reinforcement rods horizontally at a plurality of vertically spaced locations and to facilitate the completion of the mold cavity into which hardenable material is poured and allowed to harden within the mold cavity.

A still further object is to enable the formation of a completed poured-in-place building fit for occupancy within three to four days from entry onto a building site with the novel structural forming assembly, and then forming a floor slab, and an upper building wall and ceiling structure using the assembly and process of the invention.

Another object provides a freestanding monolithic building structure including a novel reinforcement cage formation composed of coextensive horizontal and vertical floor, wall, and ceiling reinforcement rods, and a plurality of freely positioned, horizontally disposed reinforcement rods that form a plurality of substantially continuous reinforcement rings encircling the perimeter of and spaced upwardly along the building wall structure at a plurality of vertically spaced locations.

Another object of the invention is to provide a wall structure molding assembly including a reinforcement rod suspending assembly that maintains reinforcement rods in a plurality of horizontal and vertical locations within a wall mold cavity when pouring hardenable material into the mold cavity.

THE SUMMARY OF THE INVENTION

The structural forming assembly of the invention comprises wall molding means for forming laterally spaced, opposed molding surfaces that define a wall mold cavity for forming a wall structure. The wall molding means includes panel holding means for vertically disposing laterally spaced wall forming panels to provide the molding surfaces along opposed sides of the wall mold cavity. The cavity has an upwardly directed top opening into which hardenable material is to be poured and hardened to produce the wall structure within the wall mold cavity. Reinforcement rod suspending means is for freely positioning and retaining horizontally and freely disposed reinforcement rod means at a preselected horizontal location spaced inwardly from each opposed molding surface within the mold cavity. Means for attaching the rod suspending means to the opposed wall forming panels is for locating the horizontally disposed rod means at spaced preselected vertical locations between the spaced molding surfaces. The rod suspending means is effective to retain reinforcement rod means in place at the preselected horizontal and vertical locations while the hardenable material is being poured into and allowed to harden within the mold cavity.

A feature of the rod suspending means includes grid means that extends upwardly along the vertically disposed molding surfaces, and is sufficiently rigid to project outwardly from one vertically disposed a molding surface and rigid enough to horizontally suspend the reinforcement rod means when the grid means is first attached to the vertically disposed molding surface. In a specific embodiment, the wall forming panels are portable for removable vertical disposition to form the wall mold cavity, and panel holding means is effective to maintain the wall forming panels independently with respect to each other in the vertical disposition. The rod suspending means includes a plurality of vertically disposed retaining means spaced horizontally with respect to each other along said opposed spaced molding surfaces. The reinforcement rod means includes a plurality of rod elements that are horizontally disposed across the plurality of grid means. The rod elements extend substantially parallel to the molding surfaces and are laterally spaced with respect to each other between the molding surfaces.

A feature of the rod suspending means of the invention includes a plurality of grid elements that extend upwardly along the vertically disposed molding surfaces and between the opposed molding surfaces. Each grid element includes a plurality of tie members horizontally disposed at spaced preselected vertical locations. The grid elements include rod locating means for maintaining the reinforcement rod means at the vertical locations and are laterally spaced inwardly from each opposed molding surface while hardenable material is being poured into the mold cavity. The rod locating means includes a pair of elongated parallel grid members fixedly connected to and transversely extending across the plurality of vertically spaced tie members at each preselected horizontal location between the molding surfaces to freely retain a reinforcement rod that extends horizontally across the plurality of vertically disposed grid elements. The reinforcement rod means includes at least two elongate rod members each freely positioned horizontally to rest on a tie member at a spaced inward distance from the opposed molding surfaces and at a spaced outward distance from a centerline located between the opposed molding surfaces.

A particular device of the invention comprises reinforcement rod suspending means for freely positioning and horizontally disposing reinforcement rod means within a wall mold cavity at a preselected horizontal location between each opposed molding surface and at a plurality of preselected vertical locations spaced upwardly along opposed wall forming panels. The device includes fastening means for attaching the reinforcement rod suspending means to each of the opposed wall molding panels to retain the reinforcement rod means in place between wall forming panels at the preselected horizontal and vertical locations while hardenable material is being poured into and allowed to harden within the mold cavity.

In a specific embodiment, the preselected horizontal location is spaced inwardly from each molding surface, the wall molding panels are portable and removable, and the reinforcement rod suspending means is removably attached to the wall molding panels and includes grid means that extends upwardly along the vertically disposed molding surfaces. The grid means is sufficiently rigid to project outwardly from a single vertically disposed molding surface and rigid enough to horizontally suspend the reinforcement rod means when the grid means is attached to that vertically disposed molding surface. The rod suspending means includes a plurality of vertically disposed retaining means spaced horizontally with respect to each other along the opposed spaced molding surfaces. The reinforcement rod means includes a plurality of rod elements horizontally placed across and retained in position on the plurality of grid means. Reinforcement rod elements extend substantially parallel to the molding surfaces and are laterally spaced with respect to each other across the width between the molding surfaces.

A particular feature of the rod suspending means includes a plurality of grid elements that extend upwardly along the vertically disposed molding surfaces and between the opposed molding surfaces. Each grid element includes a plurality of tie members horizontally disposed at spaced preselected vertical locations within a wall mold cavity. Rod locating means maintains reinforcement rod means freely positioned at the preselected vertical locations, and spaced horizontally and inwardly from each opposed molding surface while hardenable material is being poured into the mold cavity. The rod locating means includes a pair of elongated parallel grid members fixedly connected to and transversely extending across the plurality of vertically spaced tie members at each horizontal location between the molding surfaces to freely retain a reinforcement rod that extends horizontally across and rests on the plurality of vertically disposed grid elements. Each end of an upper tie member and a lower tie member has a portion thereof formed back upon itself to define a loop. Each opposed molding surface includes means for receiving the loop ends of the upper and lower tie members for removably attaching the grid elements to the wall panels. More specifically, the reinforcement rod means includes at least two elongate rod members each freely positioned horizontally on a tie member at a spaced inward distance from the opposed molding surfaces and at a spaced outward distance from a centerline located between the opposed molding surfaces.

A poured-in-place forming assembly of the invention is for producing a concrete building including a molded monolithic structure consisting of floor and ceiling slabs and inner and outer building walls that form a building that includes a plurality of rooms defined by a building floor plan. The assembly comprises floor, wall, and ceiling molding means for forming laterally spaced, opposed molding surfaces that define a mold cavity to produce the monolithic structure. Floor molding means includes an upwardly directed top slab mold opening into which hardenable material is to be poured and hardened within a floor slab mold cavity. The floor slab has a top surface and upstanding inner and outer wall portions projecting upwardly from the floor slab top surface that define the inner and outer building walls according to the building floor plan. Wall molding means define a wall mold cavity having an upwardly directed top wall mold opening into which hardenable material is to be poured and hardened within the wall mold cavity. The wall molding means includes vertically disposed inner and outer building wall mold segments having wall forming panels which are laterally juxtaposed opposed sides of the upstanding inner and outer wall portions to define a wall structure having a top plan view shape according to the building floor plan. Wall forming panels for the outer building walls include internal panels for being juxtaposed internal sides of the upstanding outer wall portion, and external panels for being juxtaposed external sides of the upstanding outer wall portions to define the outer building walls of the wall structure. Wall forming panels for the inner building walls and the internal panels for the outer building walls each has the same length to form an upper ceiling edge level defining a preselected ceiling height measured upwardly from the floor slab top surface inside each room of the building floor plan. Ceiling molding means forms an interior profile of the top wall mold opening that defines the inner building walls and the internal sides of the outer building walls of the building floor plan along the upper ceiling edge level of the forming panels of the inner building walls and internal wall forming panels of the outer building walls. The external wall forming panels of the outer building walls form an exterior profile of the top wall mold opening that defines the external sides of the outer building walls of the building floor plan. The external wall forming panels are sufficiently longer than the internal wall panels to form an upper edge along the exterior profile that extends above the height of the preselected ceiling height for producing a preselected thickness for a molded ceiling slab when hardenable material is poured into and allowed to harden within the mold cavity.

A specific feature of the wall molding means of the invention includes reinforcement rod supporting means for placing horizontally disposed reinforcement rods in a wall mold cavity defined by opposed molding surfaces. The reinforcement rod supporting means is effective to freely position and suspend reinforcement rods disposed horizontally along the opposed wall forming panels within the mold cavity between each opposed molding surface and at preselected vertical locations spaced upwardly with respect to each other. The rod supporting means includes a plurality of grid means including a plurality of vertically disposed retaining means spaced horizontally with respect to each other along the opposed spaced molding surfaces. The reinforcement rod means includes a plurality of rod elements horizontally disposed across the plurality of grid means. The rod elements extend substantially parallel to the molding surfaces and are laterally spaced with respect to each other between the molding surfaces.

A structural poured-in-place forming method of the invention comprises providing wall molding means including panel holding means for forming laterally spaced, opposed molding surfaces that define a wall mold cavity for forming a wall structure. The wall mold cavity has an upwardly directed top opening into which hardenable material is to be poured and hardened to produce the wall structure within the wall mold cavity. Then, vertically disposing first wall forming means to provide a first molding surface along one side of the wall mold cavity and providing reinforcement rod suspending means sufficiently rigid for freely positioning and retaining reinforcement rod means horizontally along the first molding surface. Attaching a first edge of the reinforcement rod suspending means to the first wall forming means to project outwardly from the first molding surface. Then freely positioning the reinforcement rod means to horizontally rest on the rod suspending means at a spaced distance from the first molding surface and at a plurality of preselected vertical locations spaced upwardly along the first molding surface. Then vertically disposing second wall forming means opposed to the first wall forming means to provide a second molding surface opposed to the first molding surface. And attaching the other outwardly projecting edge of the reinforcement rod suspending means to the second wall forming means for retaining the reinforcement rod means in place at the preselected horizontal and vertical locations while hardenable material is being poured into and is allowed to harden within the mold cavity.

In a specific embodiment, the first wall forming means includes a plurality of wall forming panels to provide the first molding surface, and the second wall forming means includes a plurality of wall forming panels to provide the second molding surface of a wall mold cavity. The wall forming panels are manually portable for removable and manual vertical disposition to form the wall mold cavity, and panel holding means independently maintains the first and second wall forming panels with respect to each other in the vertical disposition. The rod suspending means includes a plurality of grid elements that each extend upwardly along the vertically disposed molding surfaces and between the opposed molding surfaces. Each grid element includes a plurality of tie members that extend horizontally and are disposed at spaced preselected vertical locations with respect to each other. Rod locating means of each grid element maintains the reinforcement rod means at the vertical locations and spaced inwardly from each opposed molding surface while hardenable material is being poured into the wall mold cavity.

A poured-in-place forming process of the invention conducted at a building site produces a building including a molded monolithic structure consisting of floor and ceiling slabs, and inner and outer building walls that form a plurality of rooms defined by a building floor plan. The process comprises providing floor molding means for forming laterally spaced, opposed molding surfaces that define a slab mold cavity having an upwardly directed top slab mold opening into which hardenable material is to be poured and hardened within the slab mold cavity. Pouring hardenable material into the slab mold cavity and allowing it to harden and form a floor slab having a top surface, and upstanding inner and outer wall portions projecting upwardly from the floor slab top surface that define the inner and outer building walls according to the building floor plan. Then removing the floor molding means after the material has hardened to provide a cleared floor slab top surface and laterally spaced opposing sides of the upstanding wall portions in preparation for forming an upper portion of the monolithic building structure. Then providing upper building molding means forming laterally spaced, opposed molding surfaces that define an upper building mold cavity including a wall mold cavity having an upwardly directed top wall mold opening into which hardenable material is to be poured and hardened within the upper building mold cavity. Then vertically disposing internal and external forming panels having one end thereof resting on the floor slab top surface and juxtaposing the forming panels to the spaced laterally opposing sides of the upstanding inner and outer wall portions to define a wall structure having a layout according to the building floor plan. The internal forming panels being juxtaposed internal sides of the upstanding outer wall portion, and the external forming panels being juxtaposed external sides of the upstanding outer wall portions to define outer building walls of the wall structure. The internal panels for forming inner building wall mold segments and an inner wall portion of the outer building wall mold segments each having the same length to form an upper ceiling edge level defining a preselected ceiling height measured upwardly from the floor slab top surface inside each room of the building floor plan. Then horizontally disposing ceiling mold panels along the upper ceiling level of the internal forming panels of the inner and outer building wall mold segments to form an interior profile of the top wall mold opening. The external forming panels of the outer building wall mold segments form an exterior profile of the top wall mold opening and are sufficiently longer than the internal panels to form an upper edge on the exterior profile that extends above the height of the ceiling edge level of the interior profile of the top wall mold opening. Then pouring hardenable material into the upper building mold cavity to form a molded ceiling slab with a preselected thickness, and allowing it to harden and form the upper building portion of the monolithic structure and then removing the upper building molding means after the material has hardened.

A poured-in-place forming process of the invention includes vertically disposing first wall forming means to provide a first molding surface along one side of a wall mold cavity, and providing reinforcement rod suspending means sufficiently rigid for freely positioning and retaining reinforcement rod means horizontally along the first molding surface. Then attaching a first edge of the reinforcement rod suspending means to extend upwardly along the first wall forming means and to project outwardly from the first molding surface. And then freely positioning the reinforcement rod means to horizontally rest on the rod suspending means at a spaced horizontal distance from the first molding surface and at a plurality of preselected vertical locations spaced upwardly along the first molding surface. Then vertically disposing second wall forming means opposed to the first wall forming means to provide a second molding surface opposed to the first molding surface. And attaching the other outwardly projecting edge of the reinforcement rod suspending means to the second wall forming means for retaining the reinforcement rod means in place at the preselected horizontal and vertical locations while the hardenable material is being poured into and is allowed to harden within the mold cavity.

A fixed construction of the invention is poured-in-place at a building site and comprises monolithic concrete floor slab means including a floor upper surface and integrally formed upstanding wall portions projecting upwardly from the floor upper surface by an amount sufficient to form opposed lateral sides that are effective to laterally support contiguously disposed elongate wall forming panels that project upwardly from the floor upper surface for providing a wall mold cavity. The upstanding wall portions extend along the floor upper surface to define a wall structure having a layout of inner and outer walls for rooms of a building in accord with a preselected floor plan. The upstanding wall portions further include opposed laterally spaced sides that define a preselected wall thickness and that are effective to provide lateral support for panel means having molding surfaces that extend upwardly from the wall portions to form the wall mold cavity having an upwardly directed top wall mold opening into which hardenable concrete material is to be poured and hardened within the wall mold cavity.

A freestanding fixed construction of the invention is poured-in-place at a building site and comprises an enclosed monolithic concrete building structure including a floor slab having a top surface, and an upper building portion having a ceiling slab and a wall structure. The wall structure includes integrally formed upstanding inner and outer wall segments that project upwardly from the floor top surface. The ceiling slab is located at a preselected ceiling height measured from the top surface of the floor slab to the top of each wall segment. The wall structure extends along the floor top surface in a room layout of a building in accord with a preselected floor plan. The floor and ceiling slabs include horizontally disposed reinforcement rods that extend in at least one direction across the width of each slab. The upstanding wall segments include laterally spaced opposing wall surfaces and vertically disposed reinforcement rods that extend upwardly between the exterior wall surfaces and along the height of each inner and outer wall segment. A plurality of vertically disposed retaining means are horizontally spaced with respect to each other, and a plurality of reinforcement rod elements are horizontally disposed across the plurality of retaining means between the laterally spaced wall surfaces. Reinforcement rod elements extend in a direction that is substantially parallel to the wall surfaces, and are laterally spaced with respect to each other between the wall surfaces of the outer wall building segments.

In a specific embodiment, the horizontally disposed reinforcement rods within said floor and ceiling slabs extend in two horizontal directions that are perpendicular with respect to each other. The vertically disposed reinforcement rods in the inner and outer wall segments are coextensive with corresponding horizontally disposed reinforcement rods to produce a reinforcement rod cage structure disposed within the hardened floor slab, outer building wall structure, and ceiling slab. In addition, the horizontally disposed reinforcement rod elements in the outer wall building segments include at least two parallel elongate rod members each positioned horizontally at a spaced inward distance from opposed wall surfaces of the outer wall segments and at a spaced outward distance from a centerline located between those opposed wall surfaces of the outer wall segments.

BRIEF DESCRIPTION OF DRAWINGS

Other objects of this invention will appear in the following description and appended claims, reference being made to the accompanying drawings forming a part of the specification wherein like reference characters designate corresponding parts in th several views.

FIG. 6 is a diagrammatic fragmentary view, partly in section, showing the detail of the fastening device in the detail circle VI shown on the assembly of FIG. 4;

FIG. 7 is a fragmentary top plan view of the fastening device of FIG. 6 with the wall panel in section to show how the wall panel is held in place by connecting the fastening device to the loop end of a tie member of the reinforcement rod suspending means of the invention;

FIG. 8 is a front elevation view of the fastening device of FIGS. 6 and 7 with the wall panel removed to show the operation of the fastening device in attaching the loop end of a tie member of a reinforcement rod grid element of the invention.

DETAILED DESCRIPTION OF SPECIFIC EMBODIMENTS

Figure 1:
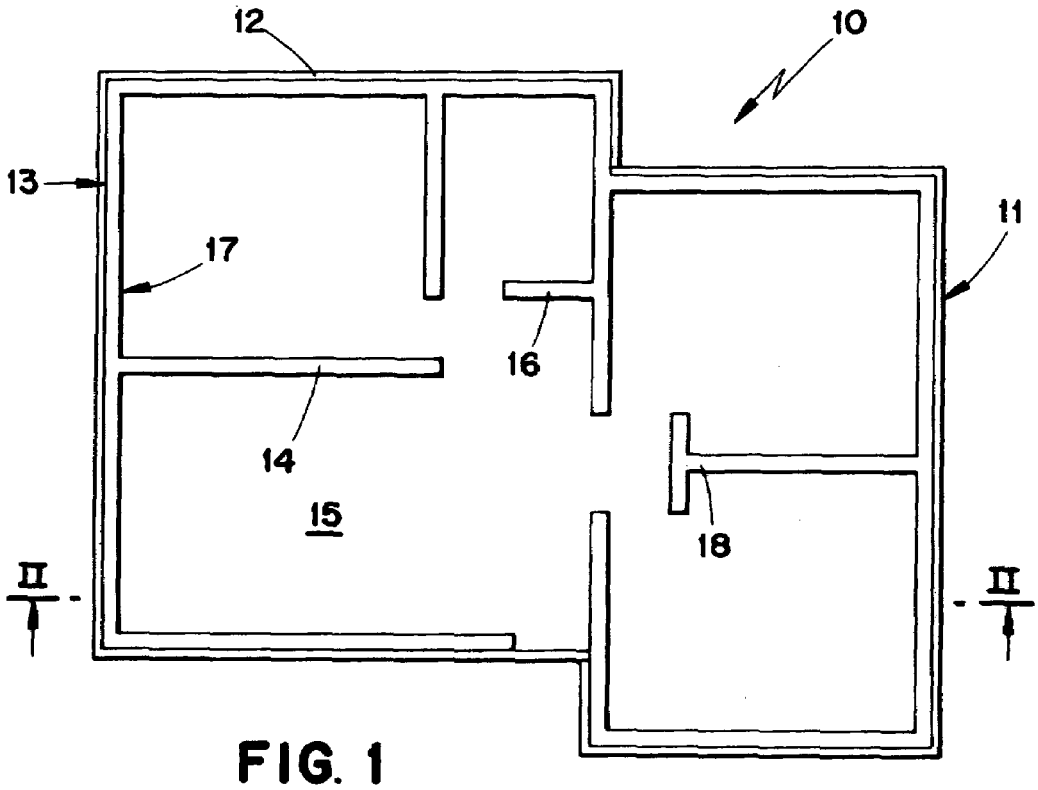
FIG. 1 is a diagrammatic top plan view of a upper building mold cavity showing the upper mold opening formed with an assembly for casting the wall structure and ceiling slab of the invention onto the upstanding wall portions of the floor slab.
Figure 2:
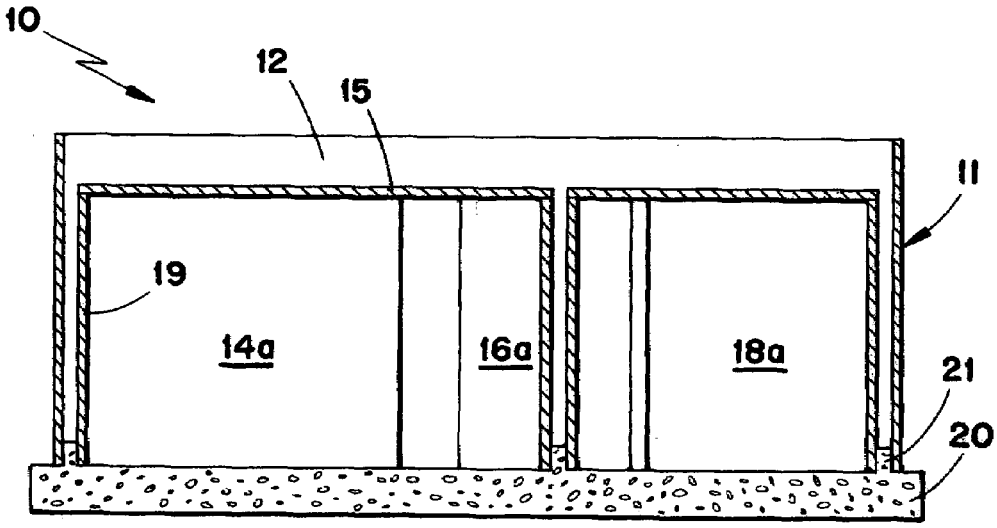
FIG. 2 is a cross-sectional view along line II-II of FIG. 1.

The structural forming assembly, generally designated 10, of FIGS. 1 and 2 includes an upper building structure 11 disposed on a concrete slab 20 having upstanding wall portions 21 that define the internal and external wall segments in accord with the preselected building floor plan as shown. Slab 20 with wall portions 21 is made using well known concrete mold fabrication techniques at the building site. Yet in recent years the prior art has developed sophisticated off-site methods of fabricating building modules that are transported to and erected on the building site to avoid formerly cumbersome poured-in-place techniques that are labor intensive thus cost ineffective until now.

Molding assembly 10 with its unique layout of upstanding slab wall portions 21, however, provides a means to quickly form laterally spaced, opposed molding surfaces that define an upper building mold cavity having an exterior wall profile 13 and an interior wall profile 17 of a wall and ceiling structure so that the entire building may be poured in a single operation. Molding assembly 10 includes panel holding means (not shown) that are used to vertically dispose and maintain laterally spaced wall forming molding surfaces juxtaposed the lateral opposing sides of wall portions 21. Such molding surfaces may thus be rapidly disposed manually along opposed sides of wall portions to accurately form the upper mold cavity for completing the building at the building site. Ceiling panels are supported on the top edge of panels 19 and panel support means at the desired ceiling height. Panels 19 provide internal molding surfaces of the outer building walls and the inner building walls. Ceiling panels 15 thus define the interior wall profile 17 and exterior wall panels 12 define the exterior wall profile 13. Upper building mold cavity 11 has an upwardly directed top opening as shown into which hardenable material is to be poured and hardened to produce the upper building structure.

In FIG. 2, wall panels 14*a*, 16*a*, and 18*a* form inner walls 14, 16, and 18, respectively, and have the same length of wall panels 19 that form the internal molding surfaces of the outer walls as shown to provide an accurate placement of ceiling panels 15. The outer wall panels 12 are longer than the internal wall panels to provide the upper ceiling mold portion of the upper building structure for forming a preselected thickness of the molded ceiling portion of the building. The particular structural configuration of the external and internal wall panels may vary in using the unique slab construction of the invention, but they must be vertically disposed to effect the mold assembly process that enables construction of an entire inhabitable building in a relatively short time.

In a specific embodiment, on the first day of construction, a slab molding assembly is erected to provide a slab molding cavity on a building site. Hardenable material such as concrete is then poured into the top opening of the slab mold cavity and allowed to harden and produce slab 20 with upstanding wall portions 21. Upper building molding assembly 11 is erected and poured the second day to produce the completed building. Molding assembly 11 is removed on the third day, and people are able to move into the building. For the first time, people who otherwise cannot afford to build and maintain more costly forms of construction are now able to own their own homes regardless of where they live.

The molding surfaces are spaced to form the mold cavity and produce the desired wall thickness that may vary from 2 to 10 inches and a ceiling thickness of from 4 to 8 inches. The height of the upstanding wall portions 21 may vary from 2 to 3 inches from the top surface of the floor slab, and the floor slab thickness will depend on the amount of upper building structure weight being supported and distributed across the building site area.

Figure 5:
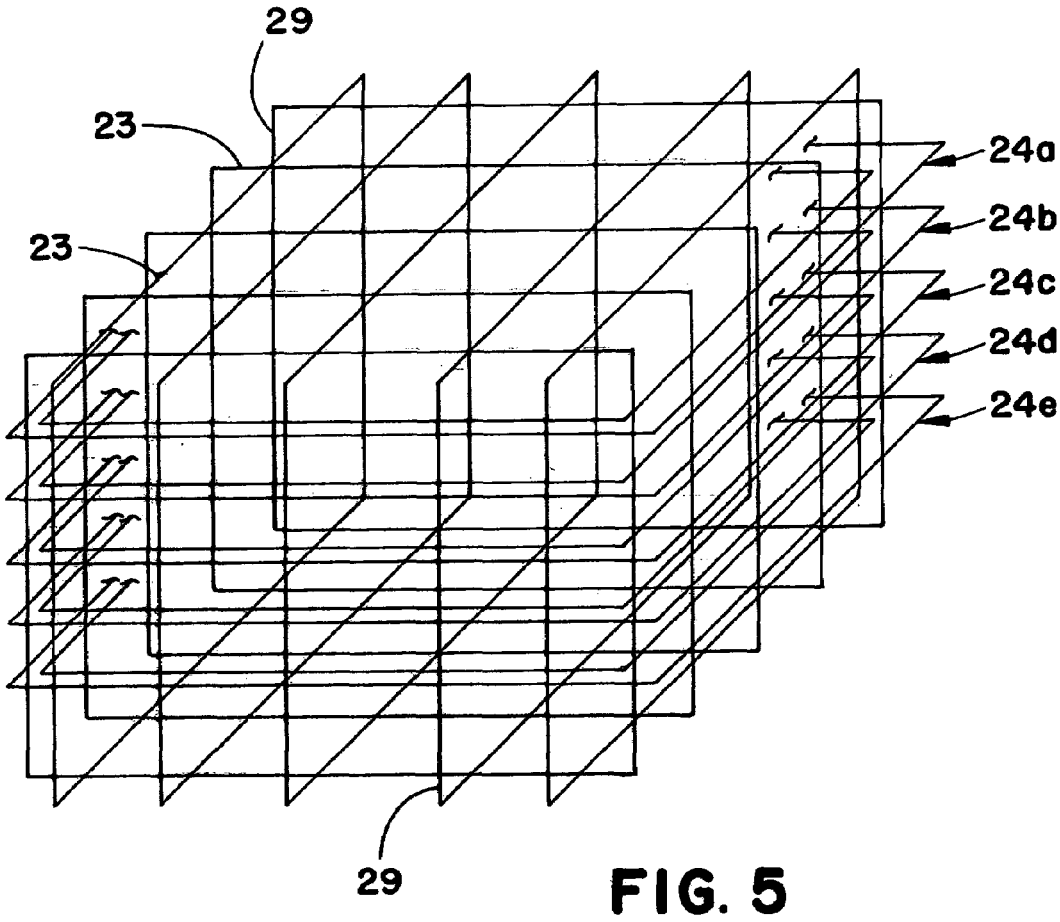
FIG. 5 is a diagrammatic fragmentary perspective view of a reinforcement rod cage structure of a novel building construction of the invention.

FIG. 5 is a diagrammatic illustration of a reinforcement rod cage structure that is used in a specific embodiment of a building made in accord with the invention that provides a structural strength that will withstand the seismic forces of earthquakes and the wind forces of tornadoes and hurricanes. Rebar reinforcement rods 23 are horizontally and perpendicularly disposed with respect to each other in the floor and ceiling slab cavities. Reinforcement rods 29 are vertically disposed in at least the outer wall cavities and coextensive with the horizontally disposed rods in the floor and ceiling cavities as shown. Reinforcement rods may also be vertically disposed in each of the inner building walls that are all load supporting walls. So with the monolithic building structure of the invention, the load of the upper building structure is distributed across the entire surface area of the building site. The building may thus be constructed without footings on various types of supporting soil so as to be freestanding to further enhance its ability to resist damage during an earthquake. In addition, at a plurality of spaced vertical locations, pairs of horizontally spaced reinforcement rods 24*a*-24*e* (shown partially around the periphery of the cage structure) are disposed at least completely around the perimeter of the building cavity to provide further lateral strength to the poured and hardened outer walls. Similar disposition of reinforcement rods is also possible in each of the inner walls of the building.

Figure 3:
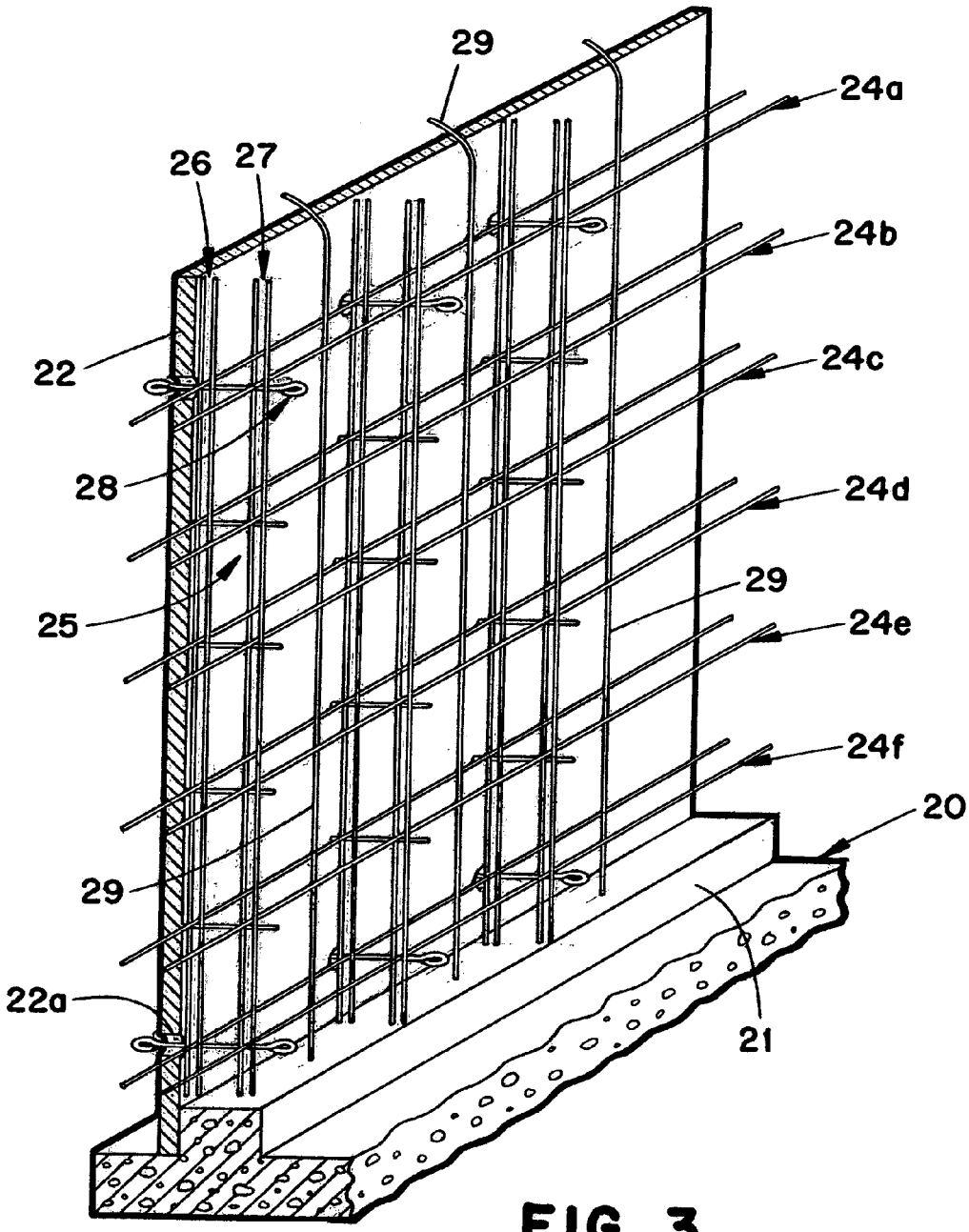
FIG. 3 is a diagrammatic fragmentary perspective view of the invention showing reinforcement rod suspending means assembled to a first wall forming panel means.
Figure 4:
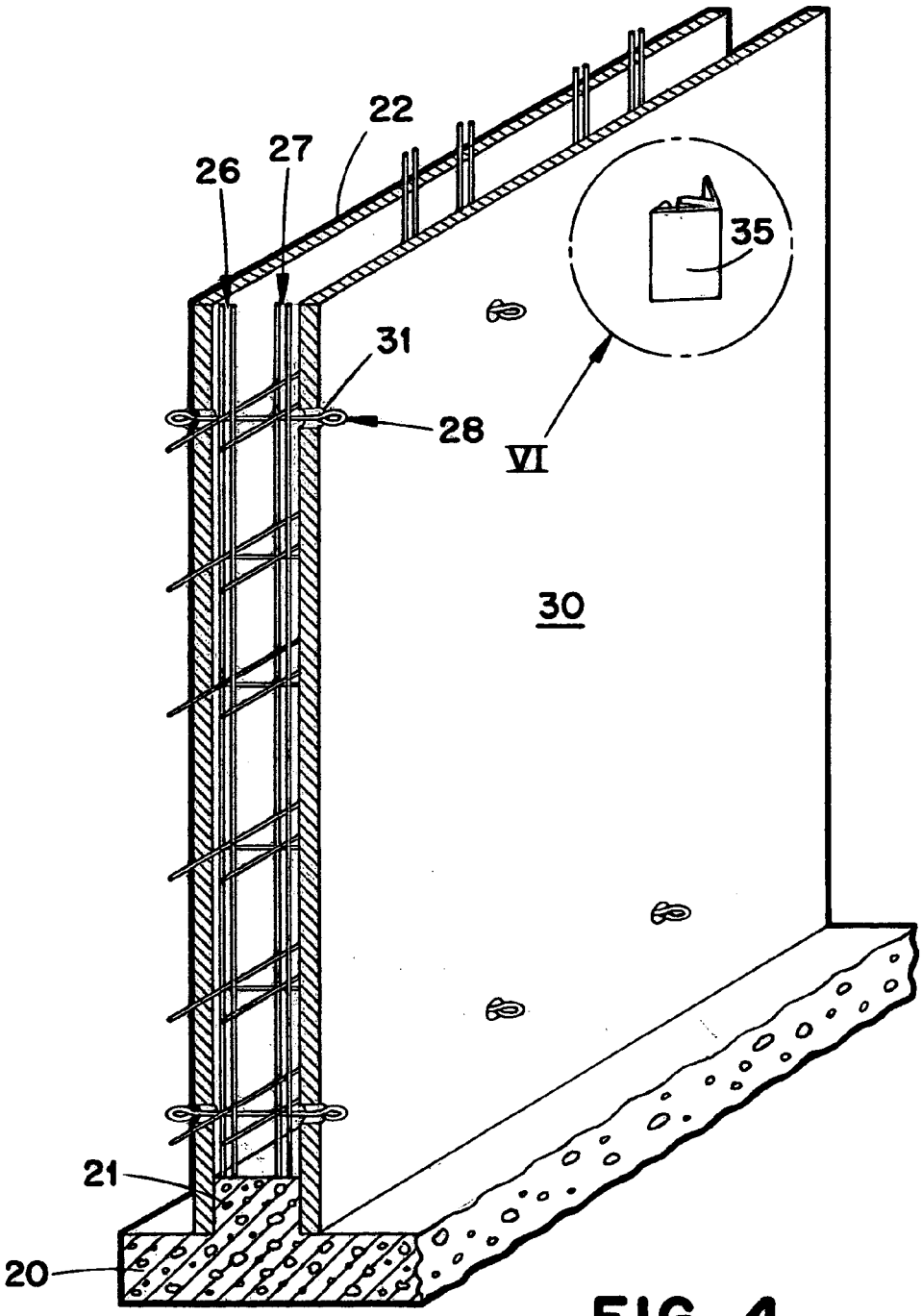
FIG. 4 is a diagrammatic fragmentary perspective view of the invention showing a vertically disposed second wall forming panel means attached to the assembly of FIG. 3 to form a wall mold cavity having a plurality of horizontally disposed reinforcement bars disposed at a plurality of preselected vertically spaced locations within the mold cavity.

FIGS. 3 and 4 illustrate a further feature of the invention that provides reinforcement rod suspending means for freely positioning and retaining horizontally and freely disposed reinforcement rods 24*a*-24*f* at preselected horizontal locations spaced inwardly from each opposed molding surface within the mold cavity. A plurality of rod suspending grid elements 25 are attached to opposed wall forming panels 22 and 30 for locating the horizontally disposed rods at a plurality of spaced preselected vertical locations between the spaced molding surfaces of panels 22 and 30. Rod suspending elements 25 are effective to retain reinforcement rods 24*a*-24*f* in place at the preselected horizontal and vertical locations while the hardenable material is being poured into and allowed to harden within the mold cavity. A horizontal rod in each pair is located on opposite sides of vertically disposed reinforcement rods 29 as also shown in FIG. 5.

Each grid element 25 has a plurality of horizontal tie members 28 with at least the top and bottom members 28 having its outer end folded back upon itself to form a loop as shown. More of the tie members 28 may have loop ends if desired. Two pairs of grid elements 26 and 27 are attached to each of the tie members 28 along the entire length of each grid element 25, which are composed of metal that has a diameter and strength effective to be sufficiently rigid to project outwardly from one molding surface as shown. Reinforcement rods 24*a*-24*f* are then freely positioned by threading them through the rod locating pairs of grid elements 26 and 27 from one end of the mold cavity being formed. Elements 25 maintain the horizontally disposed rods suspended on the molding surface of panel 22 until panel 30 is in place as in FIG. 4. A fastening element 35 attaches and fixes the loop ends of tie members 28 that project through holes 22*a* and 31 of respective panels 22 and 30. In addition to suspending and retaining horizontally disposed reinforcement rods in the wall cavity, frame members for doors and windows, electrical wiring, and plumbing may also be placed into the area to be enclosed in the floor, wall, and ceiling mold cavities.

The poured-in-place forming process of the invention thus includes vertically disposing first wall forming panel 22 to provide a first molding surface along one side of a wall mold cavity. Then attaching a first edge of a plurality of reinforcement rod suspending elements 25 to extend upwardly along the first wall forming panel 22 and to project outwardly from the first molding surface. As is evident in the drawings and this disclosure, reinforcement suspending elements or grid elements 25 are separable from the assembly. Then freely positioning the reinforcement rods to horizontally rest on the rod suspending tie members 28 at a spaced horizontal distance from the first molding surface and at a plurality of preselected vertical locations spaced upwardly along the first molding surface. Then vertically disposing second wall forming panel 30 opposed to the first wall forming panel 22 to provide a second molding surface facing the first molding surface.

A fastening element 35 attaches each loop end projecting through panel holes 22*a* and 31 for retaining the reinforcement rods in place at the preselected horizontal and vertical locations while the hardenable material is being poured into and is allowed to harden within the mold cavity. FIG. 8 details the manner in which fastener 35 holds any panel to outer edges of each grid element 25. Fastener 35 is generally V-shaped with a center projection 37 having a pin member 36 extending downwardly and parallel to its two side panels as shown. Once the loop end of tie members 28 projects through a respective hole in the wall forming panel, pin member 36 is placed through the loop as shown to effect the desired connection.

Figure 9:
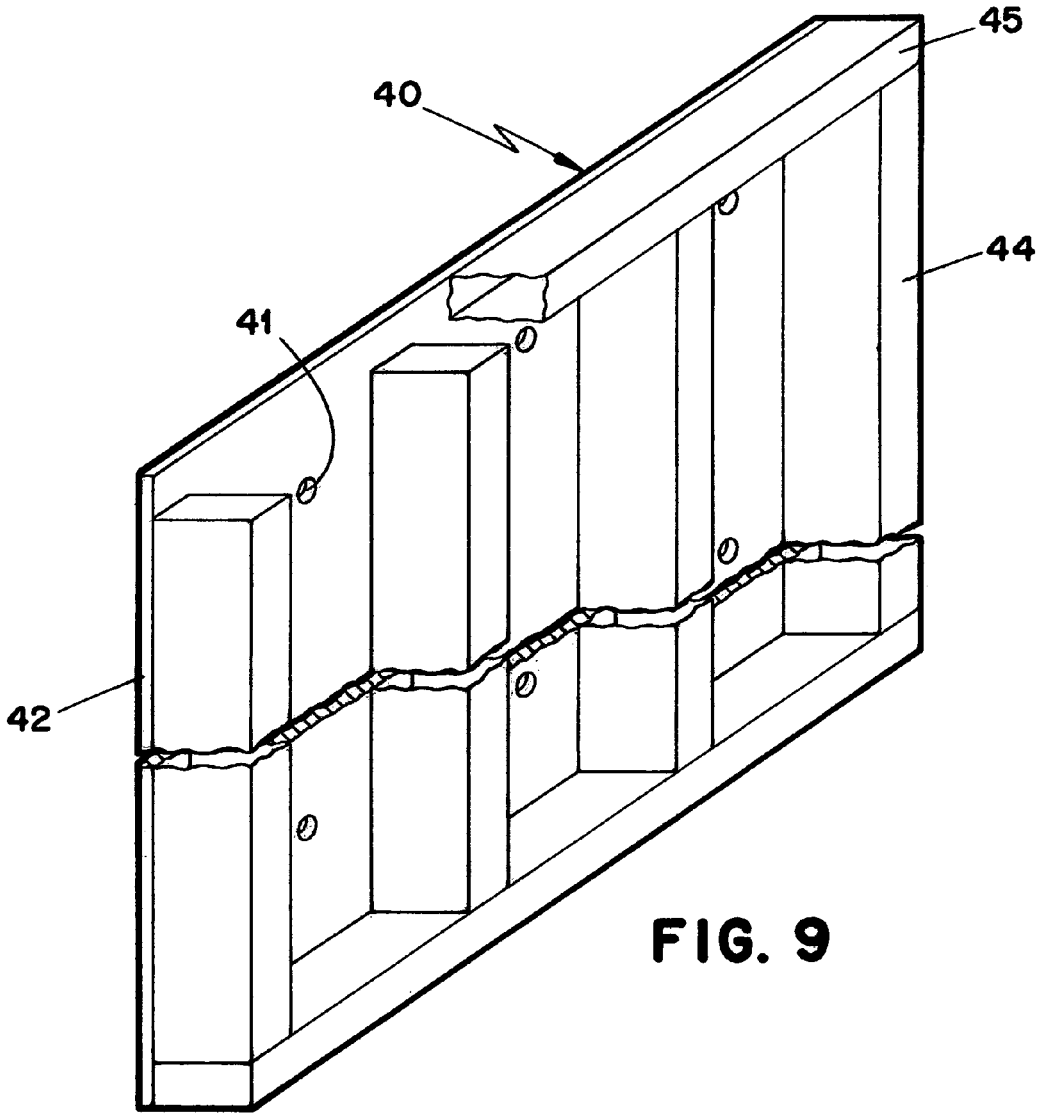
FIG. 9 is a fragmentary perspective view of a portable wall forming panel of the invention.

In a specific embodiment, a plurality of wall forming panels 40 as shown in FIG. 9 provide the first and second molding surfaces to produce a wall mold cavity. Wall forming panels 40 are lightweight and thus manually portable for manual vertical disposition to form the wall mold cavity and subsequent removal. Any known panel holding means may be used to independently maintain wall forming panels 40 with respect to each other in the vertical disposition. Each panel 40 is composed of a polyvinyl chloride (PVC) sheet 42 riveted to a plurality of hollow support rib members 44 and 45. PVC sheet 42 may have a thickness of 1/16 to 3/4 inch, and hollow, thin-walled rib members 44 and 45 are 1 inch by 2 inches and made of lightweight metal. Holes 41 are 1/2 to 5/8 inch in diameter to receive the loop ends of tie members 28 of grid elements 25. Internal wall panels 40 have a length of from about 8 to 9 feet, and external wall panels a length of from about 9 to 10 feet. Panel 40 may be made in various widths from 1 inch to 2 feet for use where needed to form a continuous molding surface.

Concrete undergoes a hydration process. So the tighter the microscopic crystals of concrete, the stronger the concrete will be. Fewer shrinkage cracks from excess water will also result from a lower-range slump installation of concrete. The prior art teaches that it is important to use a good quality concrete and to make sure that a low slump is used when effecting a poured-in-place concrete operation. Slump refers to the amount of water originally mixed in with the concrete. The higher the slump number, the more water in the concrete with a 3.5 to 4.0 slump generally preferred. A slump of this range is said to allow for easy workability and, when properly cured, gives a higher strength than a slump of 4.0 and above. Quite unexpectedly, the process of this invention uses a slump 10 to 12 to achieve a very strong steel reinforced concrete having a smooth surface that may be finished as desired.

While the building construction system has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. An assembly formed on a building site for producing a vertically disposed poured-in-place wall structure having horizontally disposed reinforcement rods, said assembly comprising:

a) wall molding means for forming laterally spaced, opposed molding surfaces that define a wall mold cavity for forming said wall structure, b) said wall molding means including means for vertically and freely disposing laterally spaced wall forming panels to provide said molding surfaces along opposed sides of said wall mold cavity, c) said cavity having an upwardly directed top opening into which hardenable material is to be poured and hardened to produce said wall structure within said wall mold cavity, d) a plurality of separable, laterally spaced grid means suspended to project outwardly from and along the vertically disposed molding surfaces in said mold cavity, each said grid means extending between said molding surfaces and including laterally spaced elongate grid elements that extend vertically and are fixedly attached to a plurality of transverse tie members each of which members is disposed at a vertically spaced location along said grid elements, e) each said transverse tie member being effective to freely and contiguously support and suspend said reinforcement rods which extend substantially parallel to said molding surfaces and are freely contiguously disposed on said transverse tie members at a plurality of vertically spaced locations within said mold cavity, and f) means for attaching said grid means to said opposed wall forming panels to retain said reinforcement rods in place at said plurality of vertically spaced locations while said hardenable material is being poured into said mold cavity and allowed to harden.

2. An assembly as defined in claim 1 wherein each said grid means has a sufficient amount of rigidity to project outwardly from a vertically disposed molding surface and to horizontally suspend the reinforcement rods when said grid means is attached to said vertically disposed molding surface.

3. An assembly as defined in claim 1 wherein said wall forming panels are portable for removable vertical disposition to form said wall mold cavity, and said means for vertically disposing said wall forming panels is effective to maintain said wall forming panels independently with respect to each other in said vertical disposition.

4. An assembly as defined in claim 1 wherein said plurality of grid means includes laterally spaced. separable grid members that extend upwardly along and between the opposed molding surfaces, each grid member includes said elongate grid elements and said plurality of tie members which are horizontally disposed at said spaced preselected vertical locations, said reinforcement rods are horizontally freely disposed contiguously on and transversely across said plurality of tie members, and said reinforcement rods are laterally spaced with respect to each other between said molding surfaces.

5. An assembly as defined in claim 1 wherein said wall molding means is removably mounted to said assembly, and each said grid means is removably suspended along the vertically disposed molding surfaces.

6. An assembly as defined in claim 1 wherein each said grid means includes an upper said tie member and a lower said tie member each having a length longer than respective lengths of a plurality of tie members laterally spaced along said elongate grid elements between said upper and lower tie members, said length of said upper and lower tie members being longer by an amount sufficient to form distal end coupling portions at each distal end of said upper and lower tie members for extending into said wall forming panels, each said opposed wall forming panel includes means for receiving said distal end portions of said upper and lower tie members, said means for attaching said grid means to said wall forming panels includes means for removably connecting each distal end coupling portion received by said wall panel means for removably attaching each grid means to said wall panels.

7. An assembly formed on a building site for producing a vertically disposed poured-in-place wall structure having horizontal reinforcement rods, said assembly comprising:

a) wall molding means for forming laterally spaced, opposed molding surfaces that define a wall mold cavity for forming said wall structure, b) said wall molding means including means for vertically and freely disposing laterally spaced wall forming panels to provide said molding surfaces along opposed sides of said wall mold cavity, c) said cavity having an upwardly directed top opening into which hardenable material is to be poured and hardened to produce said wall structure within said wall mold cavity, d) a plurality of separable, laterally spaced grid means suspended to project outwardly from and along the vertically disposed molding surfaces in said mold cavity, each said arid means extending between said molding surfaces for freely positioning and retaining freely contiguously disposed, horizontally extending reinforcement rods substantially parallel to said molding surfaces at a preselected horizontal location spaced inwardly from each said opposed molding surface within said mold cavity, and e) each said grid means including a plurality of tie members that are each disposed at vertically spaced preselected vertical locations, and means for attaching each said grid means to said opposed wall forming panels for locating said horizontally disposed reinforcement rods at said vertically spaced preselected vertical locations between said spaced molding surfaces, f) said grid means being effective to retain said reinforcement rods in place at said preselected horizontal and vertical locations while said hardenable material is being poured into and allowed to harden within said mold cavity, g) said grid means including a plurality of elongate grid elements that extend vertically along the vertically disposed molding surfaces and between the opposed molding surfaces, h) each elongate grid element being fixedly attached to said plurality of tie members that are substantially perpendicular to the molding surfaces and horizontally disposed at said spaced preselected vertical locations for contiguously supporting said freely contiguously disposed, horizontal reinforcement rods, and i) said grid elements including rod locating means for maintaining said reinforcement rods at said preselected horizontal locations spaced inwardly from each said opposed molding surface while hardenable material is being poured into said mold cavity.

8. An assembly as defined in claim 7 wherein said rod locating means includes a pair of elongated substantially parallel, vertically disposed elongate elements fixedly extending across said plurality of vertically spaced tie members at each horizontal location between said molding surfaces to freely retain a reinforcement rod that extends horizontally across and normal to the plurality of vertically disposed elongate grid elements.

9. In an assembly formed on a building site including a poured-in-place wall mold cavity defined by opposed molding surfaces on vertically disposed, opposed wall molding panels having an upwardly directed top opening into which hardenable material is to be poured and hardened to produce a wall structure with horizontally disposed reinforcement rods, the combination comprising:

a) a plurality of separable. horizontally laterally spaced grid means suspended to project outwardly from and along said opposed molding surfaces within said mold cavity, each said grid means including a plurality of tie members that are disposed at vertically spaced preselected vertical locations for contiguously supporting said horizontally extending reinforcement rods being freely contiguously disposed on said tie members, b) said grid means being effective to retain the freely contiguously disposed reinforcement rods substantially parallel to said molding surfaces at a plurality of horizontal locations vertically spaced along and between said opposed wall surfaces, and c) means for removably attaching said grid means to said opposed wall molding panels at laterally spaced horizontal distances with respect to each other to retain said reinforcement rods in place while hardenable material is being poured into said wall mold cavity and allowed to harden.

10. An assembly as defined in claim 9 wherein at least two reinforcement rods are each freely positioned horizontally at a spaced inward distance from the opposed molding surfaces and at a spaced outward distance from a centerline located between said opposed molding surfaces.

11. The combination as defined in claim 9 wherein each said grid means includes a plurality of elongate elements for extending vertically in a direction substantially parallel to the molding surfaces with said plurality of horizontal tie members being fixedly connected to and substantially perpendicular to said elongate elements, said horizontal tie members being vertically spaced with respect to each other to provide contiguous support for said reinforcement rods at said vertically spaced horizontal locations, said reinforcement rods freely contiguously resting on said horizontal tie members at laterally spaced distances inwardly from each said opposed molding surface.

12. The combination as defined in claim 9 wherein each said grid means having a plurality of elongate elements for extending vertically along said vertically disposed molding panels, each grid means having a plurality of tie members fixedly connected to the vertically disposed elongate elements far and extending substantially perpendicular to the molding surfaces to define said vertically spaced horizontal locations, said tie members being effective to contiguously, freely support the horizontally disposed reinforcement rods at a preselected horizontal location spaced inwardly from each said molding surface within said mold cavity.

13. The combination as defined in claim 9 wherein said grid means includes rod locating means for maintaining said reinforcement rods at said plurality of horizontal locations spaced inwardly from each said opposed molding surface while hardenable material is being poured into said mold cavity, said rod locating means includes two pair of elongated substantially parallel, vertically disposed elongate grid elements fixedly extending across said plurality of vertically spaced tie members at each horizontal location between said molding surfaces, each said pair of elongate grid elements being spaced by an amount effective to freely retain a reinforcement rod that extends horizontally across and normal to each pair of said elongate grid elements, each said pair being spaced inwardly from the opposed molding surfaces and spaced outwardly from a centerline located between said opposed molding surfaces.

14. The combination as defined in claim 9 wherein said means for attaching each said grid means to said wall forming panels includes a loop at each end of an upper said tie member and at each end of a lower said tie member, each said upper and lower tie members having loop end portions which are formed back upon itself to define said loops, and each opposed molding surface includes means for receiving said loop end portions of said upper and lower tie members for removably attaching each grid means to said wall panels.

* * * * *